United States Patent [19]

Weideman

[11] 4,428,546

[45] Jan. 31, 1984

[54] ADJUSTABLE SPOOL ASSEMBLY

[75] Inventor: Allen T. Weideman, North Hollywood, Calif.

[73] Assignee: Thomas & Betts Corporation, Raritan, N.J.

[21] Appl. No.: 332,717

[22] Filed: Dec. 21, 1981

[51] Int. Cl.[3] ..... B65H 75/14

[52] U.S. Cl. ..... 242/118.5; 242/71.9

[58] Field of Search ..... 242/118.4, 118.5, 118.6, 242/118.61, 71.8, 71.9, 134, 137, 137.1, 96, 116

[56] References Cited

U.S. PATENT DOCUMENTS

| | | | |
|---|---|---|---|
| 1,850,315 | 3/1932 | Crocker | 242/137 |
| 2,133,743 | 10/1938 | Githens | 242/71.8 X |
| 2,533,731 | 12/1950 | Gomberg | 242/116 |
| 2,649,260 | 8/1953 | Beneke | 242/115 |
| 2,881,985 | 4/1959 | Overmire et al. | 242/71.8 |
| 2,971,721 | 2/1961 | Jones | 242/110.2 |
| 3,041,005 | 6/1962 | Wallace | 242/116 |
| 3,536,275 | 10/1970 | Salomon | 242/85 |
| 3,717,315 | 2/1973 | Kovaleski | 242/115 |
| 3,830,445 | 8/1974 | Moore | 242/118.4 |
| 3,840,198 | 10/1974 | Moore | 242/118.4 |
| 3,846,887 | 11/1974 | Woods et al. | 29/200 |
| 4,101,095 | 7/1978 | Carter | 242/115 |
| 4,198,012 | 4/1980 | Esmonde et al. | 242/115 |
| 4,200,249 | 4/1980 | Synstelien et al. | 242/96 |
| 4,221,347 | 9/1980 | Hill | 242/110.2 |

*Primary Examiner*—Leonard D. Christian

*Attorney, Agent, or Firm*—Robert M. Rodrick; Salvatore J. Abbruzzese

[57] ABSTRACT

An adjustable spool comprises a pair of engageable, substantially identical, hermaphroditic components, each component including an end flange axially spaced from the other by an adjustable drum portion. The drum portion is defined by a plurality of axially extending splines projecting from each flange toward the other. The splines are spaced circumferentially about the axis and are arranged to interfit circumferentially in assembly. The splines are provided with a plurality of axially spaced tooth-like engagement elements. Each flange has interposed circumferentially between splines an opening for receipt therein of a free end of a spline and a latching member adjacent each opening for engaging the tooth-like members on the splines.

26 Claims, 6 Drawing Figures

ADJUSTABLE SPOOL ASSEMBLY

FIELD OF THE INVENTION

The present invention relates to an adjustable spool assembly and more particularly to a pair of hermaphroditic components for use in forming such a spool.

BACKGROUND OF THE INVENTION

The storage and transportation of coils or rolls of material such as flat conductor cables or the like are commonly provided by drum reels or spools. Such spools consist essentially of a cylindrical hub or drum portion upon which the cable is wound with spaced flanges extending at the ends of the drum. To accommodate various sizes of material, there are a number of known spool assemblies that may be adjusted whereby the spacing between end flanges is either increased or decreased. Some of the known techniques utilized in the adjustable spools include the use of various spacer elements in the drum portion, telescopic drum portions, collapsible drums, threaded tie rods and the like. Generally, the known spool assemblies have certain disadvantages such as the number of parts required to form the assembly, the difficulty in assembling and disassembling the spool and in providing the desired adjustments. Moreover, the known designs are relatively costly to manufacture owing not only to the number of parts but also to the differences in the configurations of these parts.

SUMMARY OF THE INVENTION

It is an object of the invention to provide an improved adjustable spool assembly.

It is a more particular object of the invention to provide an adjustable spool assembly utilizing identical hermaphroditic components.

In accordance with the invention, an adjustable spool assembly comprises a drum portion defining a central axis and including a plurality of axially extending members circumferentially spaced about the axis. Plural of these members have engagement elements that project from the members transversely to the central axis. A pair of end flanges are spaced from each other along the axis by the drum portion. Each flange includes engagement means disposed about the axis engaging the engagement element on the members. In one form of the invention, the drum portion is defined by the members which are formed as splines attached to and projecting axially from one or both of said flanges in a direction toward the other. Where each flange includes such splines, the splines are disposed to circumferentially interfit in the assembly. The engagement means on the flanges includes openings that are circumferentially spaced commonly with the splines and interposed therebetween, such openings adapted to receive the splines therein. In another form of the invention, the drum portion is defined by a detachable adaptor comprising such splines.

In accordance with a particular embodiment of the invention, an hermaphroditic component for use in forming an adjustable spool with another of such hermaphroditic components is contemplated. Such component comprises a flange member defining an axis therethrough and a plurality of splines projecting axially from the flange member and spaced circumferentially about the axis. Plural of the splines have a plurality of axially spaced engagement elements thereon. The flange member also includes plural engagement means disposed about the axis substantially circumferentially commonly with the splines and interposed therebetween.

DETAILED DESCRIPTION OF THE PREFERRED EMBODIMENTS

Figure 1:
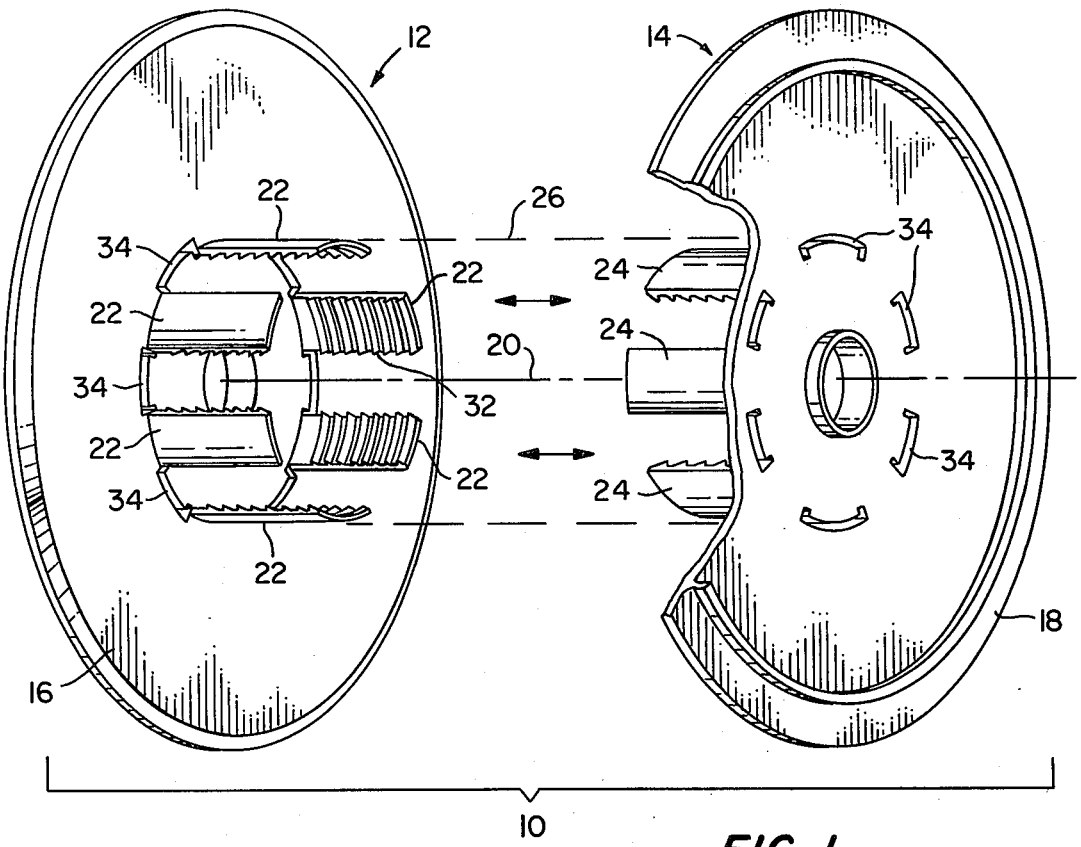
FIG. 1 is an exploded perspective view, partly broken away to show detail, of an embodiment of the invention.

Referring now to the drawing, there is shown in FIG. 1 in accordance with a preferred embodiment an adjustable spool 10 including a pair of substantially identical hermaphroditic components 12 and 14 that are adapted to engage each other to form the spool 10. Each component 12 and 14 comprises an end flange 16 and 18, respectively, that is mutually spaced from the other flange along a central axis 20. Each of the components 12 and 14 includes a plurality of axially extending members 22 and 24, respectively, that are circumferentially spaced on the respective end flanges 16 and 18 about the axis 20, the members being disposed correspondingly to interfit circumferentially to form a central drum portion 26 in assembly as will be described in detail hereinbelow.

Figure 2:
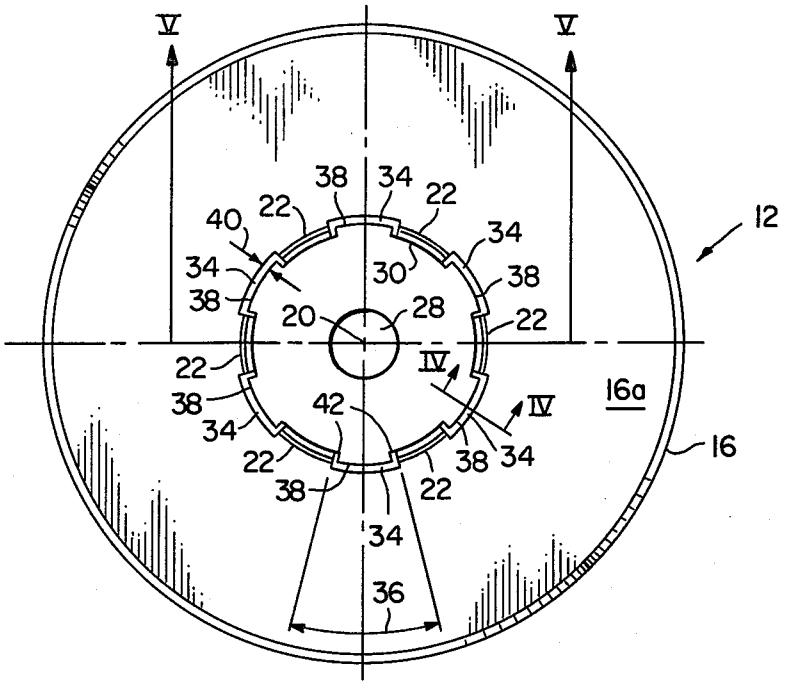
FIG. 2 is a top plan view of one of the components of the invention shown in FIG. 1.
Figure 3:
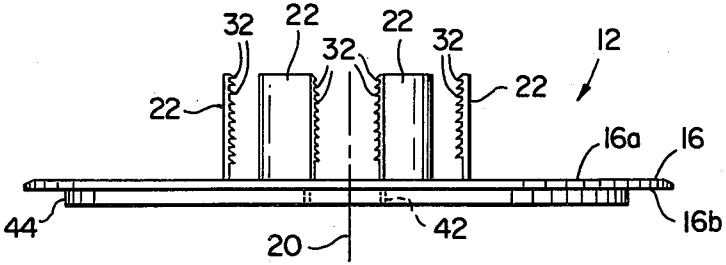
FIG. 3 is a side elevational view of the component shown in FIG. 2.

Turning now to FIGS. 2 and 3, the details of the hermaphroditic components are shown. As the configuration of each component 12 and 14 is substantially identical, the particulars of component 12 only are described herein for brevity, it being understood that the construction of component 14 is substantially identical thereto. Hermaphroditic component 12 comprises end flange 16 that is preferably in the form of a circular, substantially planar disc-like member. A central aperture 28 may be formed through opposed surfaces **16*a* and 16*b* for purposes of ease of handling and manufacture, the axis 20 adapted to pass centrally through such aperture 28**.

Projecting from surface **16*a* and substantially axially therealong are the members 22 which are in the form of individual splines. The splines 22 are spaced circumferentially about the axis 20 in a substantially circular locus, as indicated generally by the numeral 30 in FIG. 2. As depicted, there are six splines 22 disposed on the flange 16, the circumferential spacing of such splines 22** being preferably substantially equal. It should be appreciated that more or less than six splines may be used in practice and at non-equal spacings.

Preferably on each of the splines 22, as shown in FIG. 3, there are provided a plurality of engagement elements 32, in the form of tooth-like members that project from such splines 22 in a direction transverse to the axis 20. In the preferred form of the component 12, the engagement teeth 32 extend arcuately along the surface of the splines 22 in a ledge-like manner, axially spaced from each other and projecting radially inwardly toward the axis 20, as seen also in FIG. 1.

Figure 4:
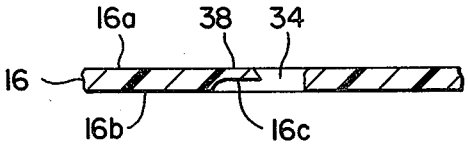
FIG. 4 is a sectional view of the component as seen along viewing lines IV—IV of FIG. 2.

Interposed circumferentially between each of the splines 22 is an opening 34 that extends through the flange surfaces 16*a* and 16*b*. The openings 34 are disposed circumferentially commonly in substantially the same circular locus 30 as the splines 22. The arcuate extent 36 of the openings 34 is formed to be slightly greater than the arcuate extent of the splines 34. The openings 34 are formed to receive therein the corresponding splines 24 of the component 14, the component 12 having engagement means, preferably at each of the openings 34 for engaging the tooth-like elements on the splines 24 substantially in the plane defined by the flange 16. In the preferred arrangement, the engagement means are defined by a plurality of resilient latching members 38 that are portions of the flange 16 adjacent each opening 34, such latching members 38 communicating with and extending into the openings 34. The radial extent of the opening, as indicated by numeral 40, in FIG. 2, is formed to be less than the transverse extent of the spline as defined by the spline thickness plus the height of the tooth thereon, such that a resilient latching member 38 will engage the tooth members 32 upon insertion of a spline 24 through an opening 34, as will be further detailed. To enhance the resiliency of the latching members 38, radial undercuts 42 are typically formed on each arcuate side thereof through the end flange 16. As shown in FIG. 4, the flange portion adjacent the opening 34 is undercut arcuately to provide a thinner flange portion 16*c*, such that portion 16*c* defines a resilient cantilevered extent communicating with the opening 34.

As shown in FIGS. 3 and 1, the flange 16 may be provided with an inner hub 42 and an outer rim 44 substantially concentric to the hub 42, the hub 42 and rim 44 projecting axially outwardly from surface 16*b* and enhancing the rigidity of the flange 16. In the preferred form, the component 12, as well as the component 14, may be integrally formed of a suitable material, such as a high impact styrene, which may be molded in a manner well known in the art.

Figure 5:
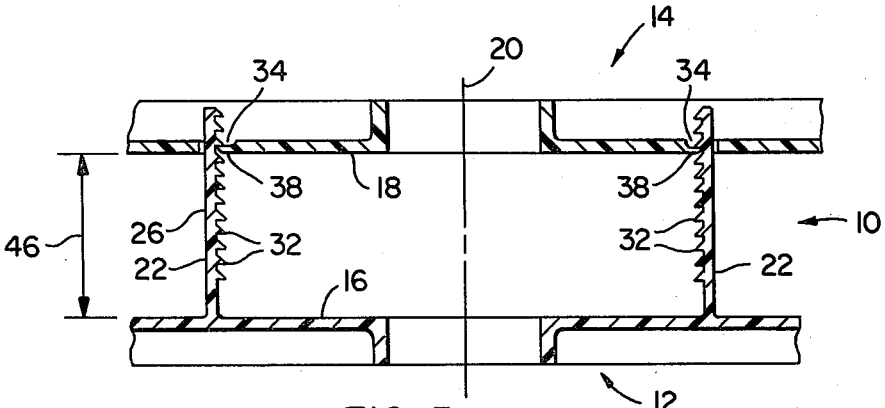
FIG. 5 is a sectioned view as seen along viewing lines V—V of FIG. 2 of the component in an assembled condition excluding background detail for purposes of clarity.

Having described the particular details of the spool components, the interengagement of the components 12 and 14 in assembly is illustrated in FIG. 5. In the assembly of spool 10, the splines 22 and 24 are circumferentially interfitted to form the drum portion 26 of the adjustable spool 10. The distal free ends of the splines 22 and 24 are inserted into the corresponding openings 34 wherein the latching members 38 resiliently engage the tooth-like members 32 on the splines. The tooth-like members 32 are formed to permit ease of insertion while a greater force is required to disassemble the spool. The spacing 46 between flanges 16 and 18, i.e., the drum portion 26, may accordingly be adjusted by the selective movement of the components 12 and 14 toward and away from each other.

Figure 6:
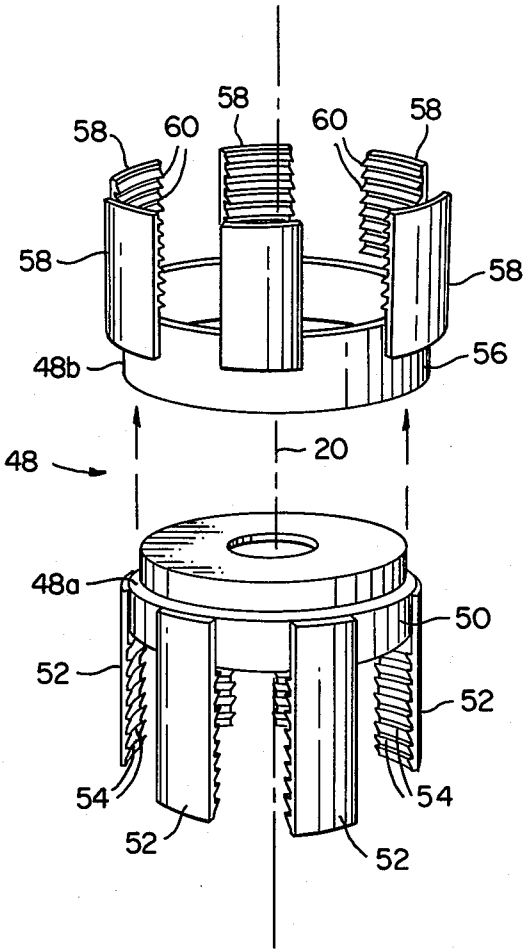
FIG. 6 is a perspective exploded view of a detachable adaptor useful in another embodiment of the invention.

While a preferred form of the invention has been particularly described herein in the embodiment of an adjustable spool comprising a pair of engageable hermaphroditic components, it should be appreciated that other variations may be contemplated within the scope of the invention. For example, while the components 12 and 14 may provide a spool that is adjustable for a relatively wide range of material widths to be coiled, it may be desirable to coil material of widths exceeding the maximum spacing of such spool. In such an instance, a detachable adaptor 48, as shown in FIG. 6, may be utilized with the components 12 and 14 to increase the spacing between the flanges 16 and 18. As shown in FIG. 6, the adaptor 48 is of generally cylindrical configuration and would define the drum portion 26 in the assembly with components 12 and 14, the axis 20 extending longitudinally centrally therethrough. The adaptor 48 is shown as comprised of two sections 48*a* and 48*b* although a unitary structure may also be used. Section 48*a* comprises a supporting member 50 from which a plurality of splines 52 project, each spline 52 preferably having tooth-like engagement elements 54 and formed similarly in construction to the splines 22 but greater in axial length. The splines 52 are formed to extend circumferentially to correspond with the flange openings 34 for insertion therein. The section 48*b* is formed with a supporting member 56 to receive the supporting member 50 therein and for securement thereto in a suitable manner. Similar to section 48*a*, section 48*b* comprises a plurality of axially extending splines 58 circumferentially spaced about axis 20 to correspond with the flange openings 34 for insertion therein. Splines 58 also include a plurality of tooth-like engagement elements 60 thereon as do splines 24. The axial lengths of splines 58, however, are greater than the axial lengths of splines 24. In assembly, for example, the splines 52 of the detachable adaptor 48 are introduced into the openings 34 of component 12, the splines 22 of component 12 interfitting with splines 52 for an axial extent. The splines 58 are introduced into the openings 34 of component 14, the splines 24 of component 14 interfitting with the splines 58 for an axial extent. The spacing between end flanges 16 and 18 is thereby increased over that afforded by the two components only and adjustability may be effected by axially moving the components 12 and 14 along the adaptor 48.

It should now be appreciated that the invention in its several aspects contemplates an adjustable spool assembly having a pair of axially spaced end flanges and a drum portion therebetween that is defined by a plurality of circumferentially spaced splines attached to and projecting axially from either or both of the flanges or by a detachable adaptor having a plurality of axially extending splines adapted for engagement with each of the flanges. In a further aspect of the invention, an hermaphroditic component is defined for use with another such component for forming an adjustable spool.

Various changes to the foregoing described and shown structures will now be evident to those skilled in the art. Accordingly, the particularly disclosed preferred embodiments are intended in an illustrative and not in a limiting sense. The true spirit and scope of the invention are set forth in the following claims.

What is claimed is:

1. An adjustable spool assembly, comprising:

a drum portion defining a central axis and including a plurality of axially extending members circumferentially spaced about said axis, plural of such members having engagement elements projecting therefrom transversely to such axis; and a pair of end flanges spaced from each other along said axis by said drum portion, each of said flanges including a plurality of openings disposed circumferentially commonly with said members about said axis and interposed therebetween for receiving said members therein, said openings being sized such that a surface portion of said end flange adjacent such openings engages said engagement elements, such end flange surface portions comprising a cantilevered resilient portion.

2. An assembly according to claim 1, wherein said engagement elements project radially from said members.

3. An assembly according to claim 1, wherein said members include a plurality of axially spaced engagement elements.

4. An assembly according to claim 1, wherein each of said members includes said engagement elements.

5. An assembly according to claim 1, wherein each of said end flanges defines a plane mutually spaced from the other, said cantilevered resilient portion of each flange lying substantially in a respective plane.

6. An assembly according to claim 1, wherein each of said members is defined by a spline attached to and extending from one of said end flanges toward the other flange, said splines defining said drum portion.

7. An assembly according to claim 6, wherein said members include a spline attached to and extending from each of said flanges respectively toward the other flange, said splines being spaced on each flange for circumferential interfitting in assembly, said interfitting splines defining said drum portion.

8. An assembly according to claim 1, wherein said drum portion is defined by a detachable adaptor comprising said members.

9. An assembly according to claim 8, wherein said adaptor includes a plurality of splines defining said members and means supporting said splines.

10. An assembly according to claim 9, wherein each of said splines includes a plurality of axially spaced engagement elements.

11. An assembly according to claim 10, wherein said adaptor is substantially cylindrical in configuration.

12. An adjustable spool assembly, comprising:

a pair of end flanges mutually spaced from each other along an axis, at least one of said flanges including a plurality of splines extending axially toward said other flange, said splines being spaced circumferentially about said axis, plural of said splines having engagement elements projecting radially therefrom, said other flange including a plurality of openings disposed about said axis in a circular locus substantially commonly with the circumferential disposition of said splines, said openings being spaced about said axis correspondingly with said splines, such other flange including a resilient latching member adjacent plural of said openings for engaging said engagement elements on said splines.

13. An assembly according to claim 12, wherein each of said splines includes said engagement elements.

14. An assembly according to claim 12 wherein said splines include a plurality of axially spaced engagement elements.

15. An assembly according to claim 12, wherein said one flange having said splines further includes engagement means thereon.

16. An assembly according to claim 15, wherein said engagement means on said one flange includes a plurality of openings spaced substantially circumferentially commonly with said splines and interposed therebetween.

17. An assembly according to claim 16, wherein said other flange includes a plurality of splines extending axially toward said one flange having splines, said splines on said other flange having engagement elements projecting radially therefrom and being spaced about said axis substantially circumferentially commonly with said openings on said other flange and in spaced disposition corresponding to the spacing of said openings on said one flange, whereby in assembly the splines on each flange are in interfitting circumferential disposition with the splines on each flange extending into respective openings on the other flange.

18. An hermaphroditic component for use in forming an adjustable spool assembly with another such hermaphroditic component, comprising:

a flange member defining an axis extending transversely therethrough, a plurality of splines projecting axially from said flange member and spaced circumferentially about said axis, plural of said splines having a plurality of axially spaced engagement elements thereon, plural engagement means on said flange member, said engagement means being disposed about said axis substantially circumferentially commonly with said splines and interposed therebetween.

19. A component according to claim 18, wherein each of said splines includes said engagement elements.

20. A component according to claim 18, wherein said engagement elements project radially interiorly toward said axis.

21. A component according to claim 18, wherein said flange member comprises a disc-like member.

22. A component according to claim 18, wherein said engagement means on said flange member comprises a plurality of openings extending through said flange member, said openings being spaced about said axis substantially circumferentially commonly with said splines and interposed therebetween.

23. A component according to claim 22, wherein a resilient latching member is disposed adjacent plural of said openings.

24. A component according to claim 23, wherein said latching member comprises a portion of said flange member communicating with such openings.

25. A component according to claim 22, wherein each of said engagement elements comprises a resilient tooth-like member.

26. A component according to claim 18, wherein said flange member, said splines, said engagement elements on said splines and said engagement means are integrally formed.

* * * * *